US007214291B2

(12) United States Patent
Gustavsson et al.

(10) Patent No.: US 7,214,291 B2
(45) Date of Patent: May 8, 2007

(54) METHOD FOR THE MODIFICATION OF CELLULOSE FIBRES

(75) Inventors: Catrin Gustavsson, Karlstad (SE); Vidar Snekkenes, Karlstad (SE); Krister Olsson, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 186 days.

(21) Appl. No.: 10/508,464

(22) PCT Filed: Mar. 21, 2003

(86) PCT No.: PCT/SE03/00473

§ 371 (c)(1),
(2), (4) Date: Sep. 21, 2004

(87) PCT Pub. No.: WO03/080924

PCT Pub. Date: Oct. 2, 2003

(65) Prior Publication Data

US 2005/0161177 A1 Jul. 28, 2005

(30) Foreign Application Priority Data

Mar. 25, 2002 (SE) ..... 0200937

(51) Int. Cl.
*D21C 9/00* (2006.01)
*D21C 3/02* (2006.01)

(52) U.S. Cl. ..... 162/9; 162/29; 162/65; 162/72; 162/78; 162/60

(58) Field of Classification Search ..... 162/9, 162/60, 65, 72, 76, 78, 87, 29
See application file for complete search history.

(56) References Cited

U.S. PATENT DOCUMENTS 1,899,637 A * 2/1933 Richter ..... 162/86
2,701,763 A * 2/1955 Sivola ..... 162/86
2,902,481 A * 9/1959 Samuelson ..... 536/56
3,423,284 A * 1/1969 Gneisz et al. ..... 162/157.7
4,622,100 A * 11/1986 Godsay et al. ..... 162/65
5,074,961 A * 12/1991 Dreisbach et al. ..... 162/72

(Continued)

FOREIGN PATENT DOCUMENTS

EP 517453 A1 * 12/1992

(Continued)

*Primary Examiner*—José A. Fortuna
(74) *Attorney, Agent, or Firm*—Rolf Fasth; Fasth Law Offices

(57) ABSTRACT

The invention relates to a method for the modification of cellulose fiber with the object of increasing the strength properties of the pulp. Cellulose derivative, preferably in the form of CMC, is added in association with alkali cooking and/or delignification of cellulose chips in a suspension with treatment fluid, in an amount exceeding 2 kg, preferably at least 5–7 kg, per ton of cellulose fibers. The addition of cellulose derivative to the suspension takes place when the suspension has a concentration of calcium released from the cellulose exceeding 20 mg/l. The conditions required for an efficient deposit of cellulose derivative onto the cellulose fibers can be established in this way, where the natural content of calcium in the wood raw material has been released and contributes to a high ionic strength, while an advantageous high temperature is established. No additional process stages are required and operating costs can be kept low.

8 Claims, 3 Drawing Sheets

U.S. PATENT DOCUMENTS

| | | | | |
|---|---|---|---|---|
| 6,824,645 | B2 * | 11/2004 | Jaschinski et al. | 162/9 |
| 6,958,108 | B1 * | 10/2005 | Vuorinen | 162/9 |
| 2004/0261960 | A1 * | 12/2004 | Gustavsson et al. | 162/19 |
| 2005/0161177 | A1 * | 7/2005 | Gustavsson et al. | 162/9 |
| 2006/0249265 | A1 * | 11/2006 | Scarpello et al. | 162/90 |

FOREIGN PATENT DOCUMENTS

| | | | |
|---|---|---|---|
| JP | 56031092 | A * | 3/1981 |
| WO | WO 9957370 | A1 * | 11/1999 |
| WO | WO 01/21890 | A1 * | 3/2001 |

* cited by examiner

METHOD FOR THE MODIFICATION OF CELLULOSE FIBRES

PRIOR APPLICATION

This application is a U.S. national phase application based on International Application No. PCT/SE03/00473, filed 21 Mar. 2003, claiming priority from Swedish Patent Application No. 0200937-1, filed 25 Mar. 2002.

TECHNICAL FIELD

The present invention concerns a method for the modification of cellulose fibers.

THE PRIOR ART

Various methods are available to influence the properties of cellulose pulp. To a large degree, various modification processes are used in which the properties of the cellulose fibres are modified in association with the formation of the paper, and following the bleaching of the pulp to its full degree of lightness.

An article is presented in Nordic Pulp and Paper Research Journal, Vol. 17, No. 1/2002, pp. 50–56 with the title: "*Studies on topochemical modification of cellulosic fibres*", by Janne Laine, Tom Lindström, Gunborg Glad and Gunnel Risinger (STFI, Swedish Pulp and Paper Research Institute, Sweden). The article describes a method in which the bleached cellulose pulp is given a higher strength. In the method, the bleached cellulose pulp is treated by the addition of carboxymethyl cellulose (CMC) at a high ionic strength. It has proved possible to deposit CMC permanently onto cellulose fibres, and the manufactured paper receives a substantial increase in its strength properties. However, the method of influencing the cellulose fibres after the completed bleaching of the fibres and before the formation of the paper requires the dilution of the suspension of cellulose fibres to a low consistency, 25 g/l (2.5%), and its modification during a long period, approximately 2 hours, at a high temperature, approximately 120° C., and at a high ionic strength, the latter being 0.05 M $CaCl_2$. This molarity corresponds to a concentration of approximately 2 g $Ca^{2+}$ per liter of fluid (the molar weight of $Ca^{2+}$ being 40.08). The relevant consistency corresponds to a fluid amount of approximately 35 $m^3$/ADT pulp (ADT=Air Dry Tonne).

This method requires a special treatment stage in which the addition of chemicals, CMC and $CaCl_2$, together with the increased costs of heating (normally using steam in an industrial process) result in increased costs for the manufactured paper. Furthermore, extra process equipment, in the form of treatment vessels and mixing equipment, is required.

AIM AND PURPOSE OF THE INVENTION

The principal aim of the invention is to modify cellulose fibres with the aim of obtaining increased strength of manufactured paper and which is not associated with the disadvantages of the prior art in the form of requirements for high consumption of chemicals, high operating costs and a requirement for expensive process equipment. Cellulose fibres can be modified using the method according to the invention as early as in association with the cooking stage and/or delignification, where a high ionic strength occurs naturally as a result of the presence of cooking liquor, principally sodium hydroxide (NaOH in the form of $Na^+$ and $OH^-$ ions), and from the concentration of calcium ($Ca^{2+}$) released from the wood raw material.

In this way, an integrated process can be achieved in which special treatment vessels and/or addition of calcium are not required.

In one special embodiment, cellulose derivative, preferably in the form of CMC, is added batchwise at the start of an alkali treatment stage in association with the cooking/delignification, which is followed by a wash in which the washing filtrate is led in a countercurrent flow though the flow of pulp. A high concentration of CMC can be built up in the process in this way, with a minimum of addition of CMC to the process.

DETAILED DESCRIPTION OF PREFERRED EMBODIMENTS

Figure 1:
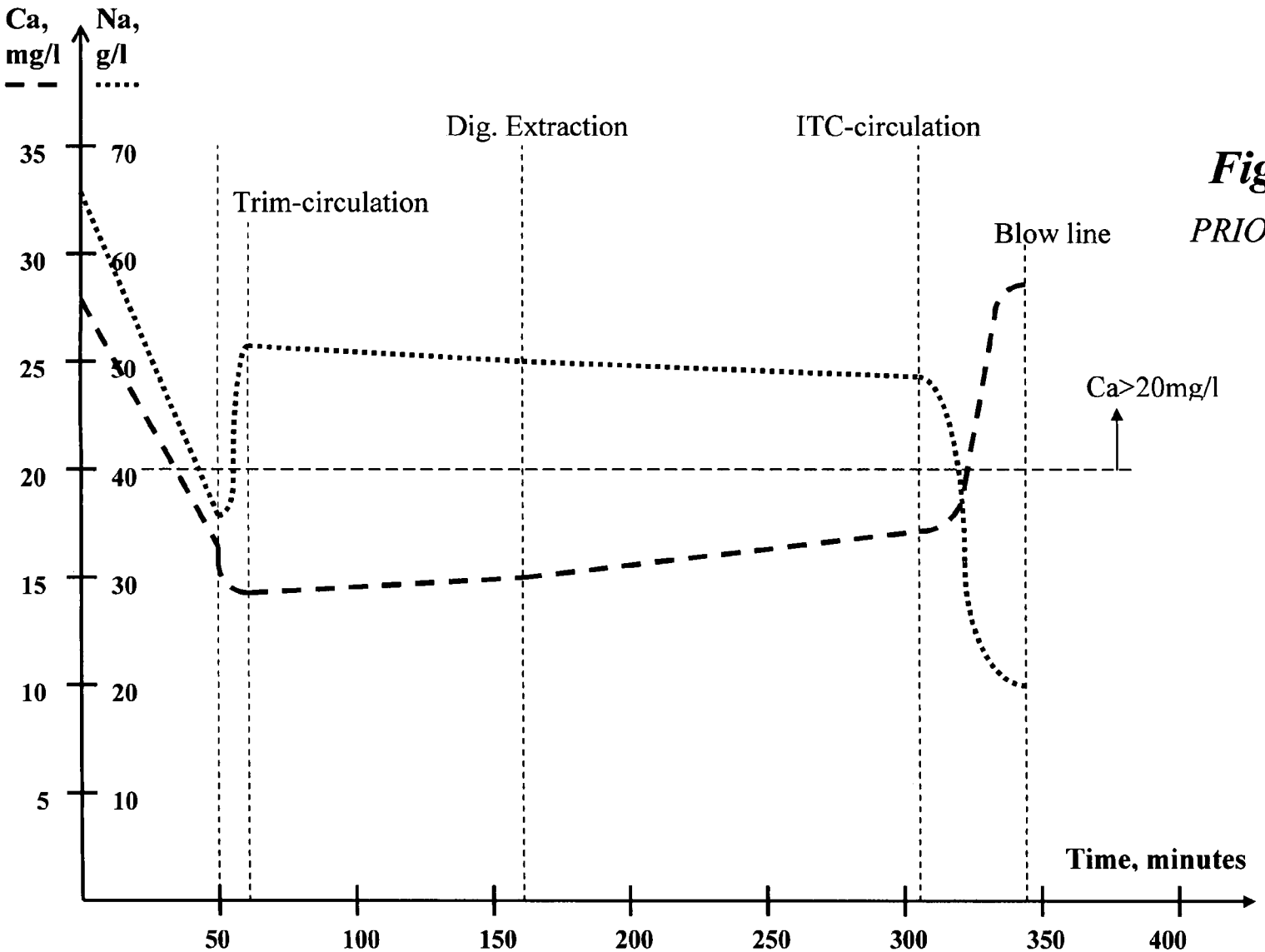
Fig.1 PRIOR ART
FIG. 1 shows the concentrations of calcium and sodium during a modified cooking process in a continuous digester.

The invention concerns a method for the modification of cellulose fibres in association with the alkali cooking and delignification of cellulose chips in a suspension with treatment fluid. The treatment fluid can be constituted by new or used cooking fluid (that is, white liquor or black liquor), together with various proportions of filtrate and/or mixtures of these.

The strength of the pulp is improved by the addition of cellulose derivative in association with the cooking stage at a level greater than 2 kg per tonne cellulose. Up to 10–20 kg of cellulose derivative in the form of CMC can be added batchwise at least initially to the cooking process. The concentration of pulp at the relevant location during impregnation is approximately 10%, which corresponds to an amount of fluid of approximately 8.1 $m^3$/ADT pulp.

If the washing filtrate from a subsequent washing stage is led in a countercurrent flow through the flow of pulp, a high concentration of CMC can be built up with considerably lower continuous batchwise addition of CMC to the process. Up to 25–60% of the CMC present in the treatment fluid is deposited onto the fibres, and the remainder can be washed out in subsequent stages and returned to the location of addition. This concentration of CMC can be successively built up in a continuous process such that a concentration equivalent to that obtained with an initial addition of 20 kg (i.e. before the CMC concentration has been built up by the return of CMC) can be obtained with the new addition batchwise of 5–7 kg CMC. The cost of chemicals for an addition of CMC will be in a continuous process as low as SEK 75–105 per tonne pulp (with a concentration of CMC of 5–7 kg per tonne of pulp), which is commercially acceptable for a pulp having improved strength properties, since the wood raw material normally commands a price of approximately SEK 1,500, or just over EUR 160, per tonne of pulp, and where the manufactured pulp normally has a manufacturing cost of approximately SEK 3,000–4,500 per tonne.

The cellulose derivative is preferably constituted by CMC (carboxymethyl cellulose), a substance that is sold as a powder. The current cost for CMC is approximately SEK 15/kg Oust over EUR 1.5/kg).

CMC is manufactured commercially for a number of purposes in a process consisting of eight stages, where the initial material is cellulose. The eight stages are constituted by:

1 The cellulose is made alkali using NaOH
2 Grinding
3 Addition of monochloroacetic acid ($ClCH_2COONa$) to achieve carboxymethylation
4 Neutralisation through the addition of HCl and $CH_3OH$
5 Filtration
6 Washing
7 Grinding
8 Drying.

The substance produced by this procedure is named Na carboxymethyl cellulose, which is abbreviated as "CMC".

Other substances from the group of cellulose derivatives can be used as alternatives to CMC, as the following list makes clear. The list also specifies the reagents used for the manufacture of the various cellulose derivatives.

| Raw material | Reagent | Product | Example |
|---|---|---|---|
| Cellulose | Inorganic acid | Cellulose ester | Cellulose nitrate |
| " | Organic acid | Cellulose ester | Cellulose acetate |
| " | Alkali | Alkali cellulose | Na-cellulose |
| " | Alkali metal + $NH_3$ | Cellulosate | Na-cellulosate |
| " | Alkali + $CS_2$ | Cellulose thioester | Cellulose xanthate |
| " | Alkali + alkyl chloride | Cellulose ether | ethyl cellulose |
| " | Alkali + alkene oxide | Cellulose ether | Hydroxyethyl cellulose |
| " | Metal complexes | Cellulose metal complexes | Cellulose cadoxen complex |
| " | Vinyl monomer + catalyst | Graft copolymer cellulose | Polyacrylnitrile |

However, CMC is the cellulose derivative that is preferred of the cellulose derivatives listed above, principally with respect to the cost and the toxicity during manufacture and handling of the cellulose derivative. When it is specified in the following description that CMC is used, this is only the most preferred embodiment, and any other of the cellulose derivatives given in the list above can be used.

CMC is added to the cellulose suspension in association with the cooking stage such that this addition of cellulose derivative is present in the suspension when the treatment fluid has released from the cellulose a concentration of calcium that exceeds 20 mg/l. The wood raw material always contains naturally a relatively high amount of calcium, although this amount can vary somewhat depending on the soil in which the trees have grown. Calcium is also present in white liquor and in washing fluid, and it is naturally present in the water that is added to the process. White liquor normally can have a calcium concentration, $Ca^{2+}$, that approaches 17 mg/l. FIG. 1 shows typical levels in the treatment fluid of the concentration of calcium released from the wood raw material, measured as mg/liter of treatment fluid found in a system with a continuous digester of a modified type.

At the start of the input system (at time 0 minutes), in this case when the pulp suspension has been fed into an impregnation vessel, the concentration of calcium released from the wood raw material is relatively high, typically around 27–28 mg/l. The calcium concentration has fallen to approximately 16 mg/l after approximately 50 minutes' retention time in the impregnation vessel, principally as a result of dilution by hot liquor and other process fluid with low calcium concentration.

During the main part of the cooking process the concentration of calcium falls to a level around 14–15 mg/l, subsequently to rise again to a high concentration of calcium, approximately approaching 26–28 mg/l, in association with blowing out/output of the cooked chips. The increase in calcium concentration is obtained when washing/diluting fluid is added at the bottom of the digester, which cooking/diluting fluid is constituted by a filtrate from a subsequent stage in which more calcium has been released from the wood. Calcium in the wood otherwise constitutes a problem in the manufacture, since calcium causes deposits, known as "scale", on the process equipment. These deposits are difficult to dissolve.

FIG. 1 makes it clear that in order to take advantage of a high ionic strength, which is advantageous for the deposition of CMC onto the fibres, it is an advantage if the CMC is present either during at least the initial phase of the cooking stage and/or in association with the termination of the cooking process, or in subsequent alkali treatment stages. These subsequent alkali treatment stages, which release calcium from the wood raw material, may, for example, be constituted by a subsequent oxygen gas delignification in one or several stages.

A temperature of approximately 130–160° C. is established during the cooking stage, and this high temperature is also advantageous for the deposition of CMC onto the fibres.

A somewhat lower temperature, in the region of 100–140° C., is often established during the input to the cooking stage, but this is compensated to a certain extent by the additive effect of the batchwise addition of white liquor, which creates a very high ionic strength, something that is obtained not only from the presence of $Na^+$ ions, but also from that of $Ca^{2+}$ ions.

A high degree of deposition of cellulose derivative principally takes place during the latter part of the cooking stage, or in association with subsequent alkali treatment stages, most often oxygen gas delignification, in which the cellulose fibres have been freed to a greater extent, whereby the added cellulose derivative has greater free accessible fibre surface onto which to be deposited.

The process position that is most advantageous, during or after the cooking stage, or at the start of the cooking stage, is determined by the relevant values of ionic strength, temperature and retention time in combination with freed fibre surface area, and thus this position can vary depending on the particular process used.

Figure 2:
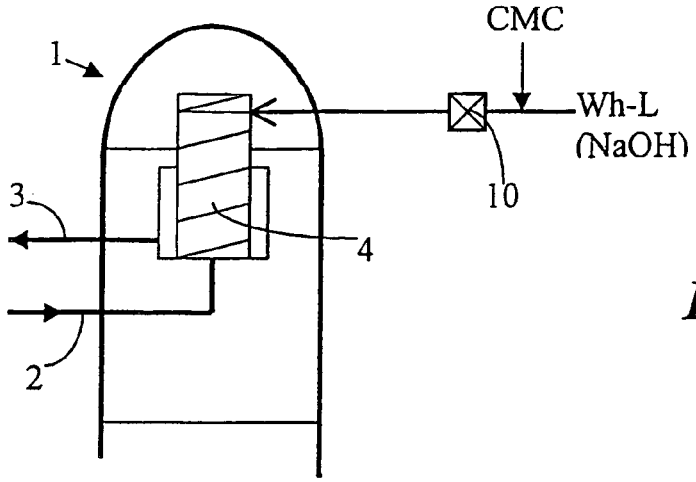
FIG. 2 shows an arrangement for the addition of CMC at the top of the digester, in association with the addition of white liquor.

FIG. 2 shows a system in which the addition of cellulose derivative, preferably CMC, takes place at the top of the digester 1 in association with the addition of white liquor (Wh-L). Chips are input in a cellulose suspension through the flow 2 to an inverted top separator 4, in which a major part of the fluid in the cellulose suspension is extracted for return to the feed system through the return line 3. It is appropriate that the addition of cellulose derivative takes place in association with the major part, corresponding to at least 60%, of the addition of alkali being added to the treatment fluid, which normally takes place at the top of the digester. FIG. 2 shows that the CMC additive, preferably in the form of a powder, is mixed into the white liquor followed by mixing with a suitable mixer 10. CMC can also be added to the principal flow of white liquor before this is divided at various locations of batchwise addition in the cooking procedure.

Figure 3:
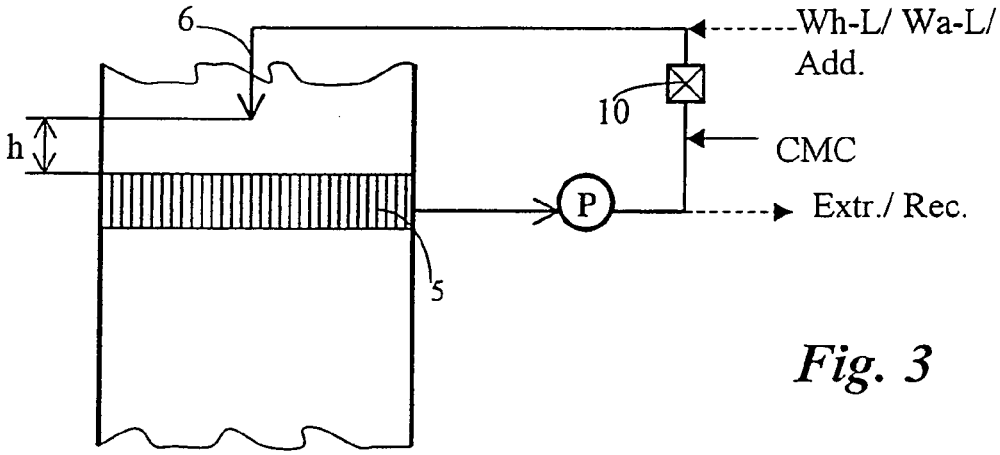
FIG. 3 shows an arrangement for the addition of CMC to a digester flow.

FIG. 3 shows a variant in which the addition of cellulose derivative takes place in association with the flow of the treatment fluid around the cellulose through an external flow. An extraction strainer 5 is shown here arranged in the wall of the digester, from which cooking fluid is extracted by a pump P, in order subsequently to be returned to the centre of the digester through a central pipe 6 in a conventional manner. The central pipe 6 can open at the same level as the strainer (h=0) or at another distance h above or below the strainer 5 in order to obtain a suitable radial flow for the current cooking process. This flow can be a heating flow with heat exchangers (not shown in the figure) arranged in the flow circuit, or it can be a flow in which the cooking fluid is modified through the extraction of used cooking fluid to recovery (Ext./Rec.) and replaced by either one or several of white liquor (Wh-L), washing/dilution fluid (Wa-L) or another cooking supplement (for example, anthraquinone, polysulphide, etc.).

Figure 4:
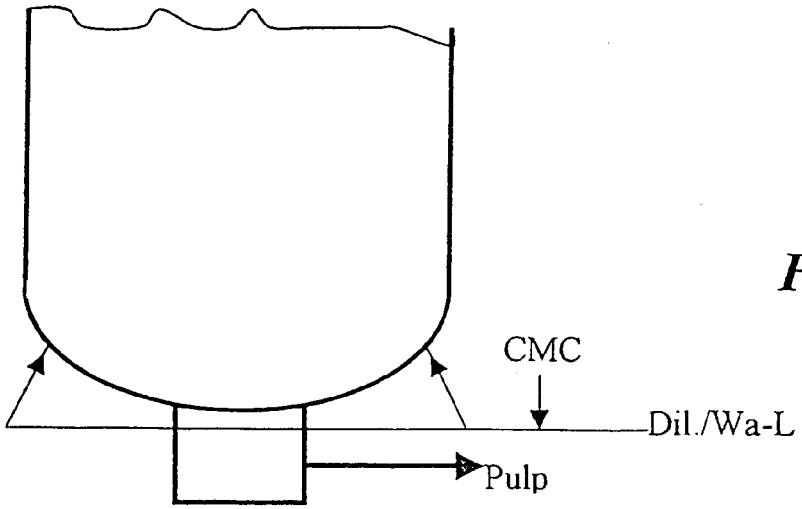
FIG. 4 shows an arrangement for the addition of CMC at the bottom of the digester in association with the addition of dilution/washing fluid.

FIG. 4 shows a further variant in which CMC is added in association with the cooking stage, which in this case takes place in association with the addition of a washing fluid (Dil./Wa-L) at the bottom of the digester such that the added fluid is led through the cellulose with the aim of expelling previously used treatment fluid and/or diluting the cooked pulp to a suitable consistency in association with the output (Pulp).

Figure 5:
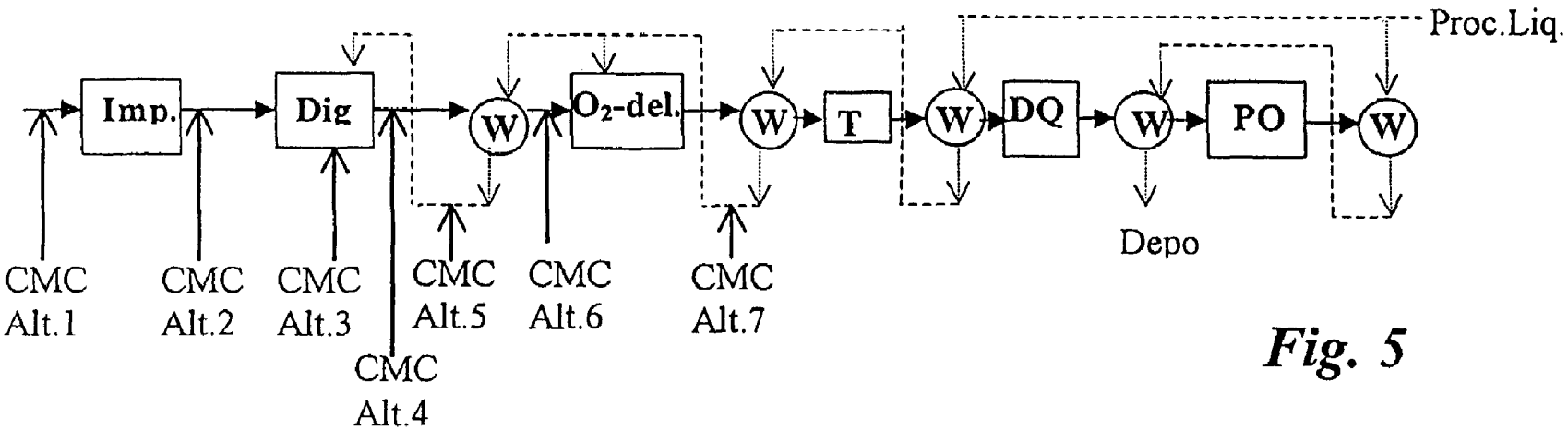
FIG. 5 shows schematically a fibre line for the manufacture of bleached cellulose pulp in which CMC can be added batchwise at a number of different locations.

FIG. 5 shows an example of a fibre line for the manufacture of bleached pulp. The chips are fed in a conventional manner to an impregnation stage Imp. The chips are there first steamed and impregnated. In a first alternative, cellulose derivative, preferably CMC, is added batchwise as early as this location. It is possible that the CMC in powder form can be mixed with the dry chips before being heated with steam in order to expel air, something that normally takes place by steaming in a chip pocket.

Cellulose derivative, preferably CMC, can, in a second alternative, be added during the transfer between the impregnation Imp. and the cooking in the continuous digester Dig.

Cellulose derivative, preferably CMC, can, in a third alternative, be added at 5 the digester, for example, in the manner that is shown in any one of the FIG. 2, 3 or 4.

Cellulose derivative, preferably CMC, can, in a fourth alternative, be added to the pulp that is output from the digester, which thus can take place in a location before a subsequent wash.

Cellulose derivative, preferably CMC, can, in a fifth alternative, be added to the washing filtrate that is obtained from the subsequent cooking wash. Cellulose derivative, preferably CMC, can, in a sixth alternative, be added before the oxygen gas delignification ($O_2$-del.). When addition takes place at this location, the cellulose derivative can be present during an extended period, typically 90–120 minutes, at a relatively high temperature and during a process stage in which high concentrations of calcium in the treatment fluid are obtained. As FIG. 1 makes clear, a very high concentration of calcium is obtained in the filtrate that is input to the bottom of the digester before the output. The filtrate in FIG. 1 has been obtained from a subsequent sequence with brown stock wash-oxygen gas delignification-wash, in which the washing filtrate obtained is led in a countercurrent flow.

Cellulose derivative is added, in a seventh alternative, to the filtrate from the first of two possible washing stages that follow the oxygen gas delignification. It is normally, but not necessarily, the case that two washing stages in series are present between the oxygen gas stage and the subsequent bleaching plant, where a storage tower T is usually used between the washing stages. Thus cellulose derivative can be added to the pulp before it is fed to this tower in order to exploit any retention time in the tower for the deposit of cellulose derivative onto the fibres, and where the remaining amount of free cellulose derivative that has not been deposited onto the fibres is washed out in the subsequent second wash.

Cellulose derivative, preferably CMC, is added in all of these seven alternatives at an alkali process location at which calcium in filtrate or in cooking fluid is used to establish a high ionic strength in the treatment fluid.

Calcium, $Ca^{2+}$, is naturally present in the raw wood, and it is also normally present at high concentrations in the water that is added to the process, and calcium is preferably principally precipitated in acidic treatment stages. A high concentration is also established in the white liquor at most mills.

Bleaching by a suitable bleaching sequence normally follows the alkali treatment stages. A bleaching sequence (DQ)(PO) is shown in the figure that, together with cooking to a kappa value lower than 25 and a powerful oxygen gas delignification down to a kappa value in the region 8–12, manages to bleach the pulp to a value greater than ISO 85. Chlorine dioxide (D) is used in the first bleaching stage followed directly by chelation (Q), which results in a washing filtrate from a subsequent wash with a high metal content, after which the pulp is completely bleached in a pressurised peroxide stage (PO). It is appropriate that both the D stage and the PO stage are high temperature stages, i.e. they take place at temperatures greater than 90–95° C. Filtrate is normally sent from the wash after DQ for destruction/deposition, since it is not desired that the leached and bound metals are returned to the process.

Normally, a combination of alkali and acidic treatment stages is used in order to achieve a fully bleached pulp. Typical acidic stages that can be used are D-stages, A-stages (acidic stages), Z-stages (ozone stages) and Pa-stages (peracidic stages). Washing filtrate from these stages is most often not suitable for return in a strict countercurrent flow before an alkali stage, not only since this would require a batchwise addition of alkali that would be too high and uneconomic in order to establish the higher pH value for the alkali stage, but also since the problems of scaling that can arise with a too hard termination of the processes, and since precipitated metals and precipitated organic material would be returned.

At the same time, the acidic stages extract calcium from the cellulose fibres such that the amount of calcium remaining in the cellulose is very low. This is why it is important that the addition of the cellulose derivative takes place at an early location in the process before the cellulose fibres have been exposed to a bleaching treatment at a pH lower than 7.0, such that a maximal effect of the calcium concentrations that occur naturally in the wood raw material can be exploited for the precipitation of the cellulose derivative onto the cellulose fibres. When this precipitation of cellulose derivative has been obtained, the remaining amount of calcium can be extracted from the process since it is no longer required.

Other types of bleaching sequences can also be used, such as, for example, D-E-D-E-D (with intermediate washes), or variants with extraction stages reinforced with peroxide (EOP).

The concentration of calcium can be built up by washing or dewatering the cellulose fibres that have been treated with cellulose derivative after the treatment, and by returning the filtrate that is obtained from the wash/dewatering to a process location before the relevant wash/dewatering, as is shown in FIG. 5, not only from the wash W after the digester Dig but also from the wash W after the oxygen gas delignification $O_2$-del, which takes place under alkali conditions.

The cellulose derivative is added in one preferred embodiment of the invention at the start of the manufacturing process in an alkali stage at which the pH exceeds 7.0, and the addition of cellulose derivative takes place before the cellulose fibres have been exposed to any treatment in acid conditions at a pH lower than 7.0. It is possible in this way to lead the filtrate in a strict countercurrent flow in the process and preserve the calcium that is released from the wood, something that is beneficial in order to obtain the best possible deposition effect from the addition of cellulose derivative.

The invention can be varied in several ways within the framework of the attached claims.

For example, addition of cellulose derivative can take place to the treatment fluid in a batchwise cooking procedure known as "batch cooking". The cellulose derivative can be added during batch cooking either to the warm or to the hot black liquor that is initially used in order to impregnate and to heat the chips that have been fed to the cooking vessel. Cellulose derivative can also be added batchwise to a washing filtrate that is used to terminate the cooking stage in the cooking vessel.

When early batchwise addition of a cellulose derivative to the cooking stage before the extraction (Dig. extraction, see the typical location shown in FIG. 1) of used cooking liquor, known as "black liquor" is used, the extracted black liquor, which contains cellulose derivative, can be exposed to partial evaporation of the black liquor to give a higher dry content, after which this black liquor, which may have been exposed to partial evaporation, is returned to the impregnation stage in order in this manner to return cellulose derivative to the process.

While the present invention has been described in accordance with preferred compositions and embodiments, it is to be understood that certain substitutions and alterations may be made thereto without departing from the spirit and scope of the following claims.

The invention claimed is:

1. A method for the modification of cellulose fibers comprising: adding a treatment fluid during alkali cooking or during delignification of cellulose chips in a cellulose suspension;

the treatment fluid releasing from the cellulose fibers a concentration of calcium ions exceeding 20 mg/l;

when the concentration of calcium ions established from calcium ions released from the cellulose fibers is exceeding 20 mg/l, adding an additive of cellulose derivative in an amount exceeding 2 kg per ton of cellulose to the cellulose suspension during the alkali cooking or during delignification so that the additive of cellulose derivative is present in the cellulose suspension when the calcium concentration is exceeding 20 mg/l.

2. The method according to claim 1 wherein the addition of the additive of the cellulose derivative takes place in association with a major part, equivalent to at least 60%, of a total charge of alkali added to the treatment fluid.

3. The method according to claim 2 wherein the addition of the additive of the cellulose derivative takes place as an addition to a complete flow of white liquor that is charged to the cellulose fibers.

4. The method according to claim 1 wherein the addition of the additive of the cellulose derivative takes place in association with a flow of treatment fluid around the cellulose fibers through an external flow.

5. The method according to claim 1 wherein the addition of the additive of the cellulose derivative takes place in association with a washing fluid being led through the cellulose fibers to expel previously used treatment fluid.

6. The method according to claim 1 wherein the cellulose fibers that have been treated with the additive of the cellulose derivative are washed or dewatered after the treatment, and a filtrate obtained from a wash/dewatering step is returned to a process location in a pulp flow before the wash/dewatering step.

7. The method according to claim 6 wherein the addition of the additive of the cellulose derivative and return of the filtrate establish a concentration of a cellulose derivative in the cellulose suspension that is equivalent to an amount of 10–20 kg cellulose derivative per ton of pulp.

8. The method according to claim 1 wherein the addition of the additive of the cellulose derivative takes place at an alkali stage at which a pH value exceeds 7.0, and the addition of the additive of the cellulose derivative takes place before the cellulose fibers have been exposed to treatment at acid conditions at a pH value lower than 7.0.

* * * * *